US008266744B2

(12) United States Patent
Song et al.

(10) Patent No.: US 8,266,744 B2
(45) Date of Patent: Sep. 18, 2012

(54) INFLATABLE PAD HAVING REINFORCING BELTS

(76) Inventors: Rong-Jyh Song, Taipei (TW); Tsung-Ping Yen, Taipei (TW)

( * ) Notice: Subject to any disclaimer, the term of this patent is extended or adjusted under 35 U.S.C. 154(b) by 159 days.

(21) Appl. No.: 12/905,553

(22) Filed: Oct. 15, 2010

(65) Prior Publication Data

US 2012/0031265 A1 Feb. 9, 2012

(30) Foreign Application Priority Data

Aug. 9, 2010 (CN) ..... 2010 2 0284747 U

(51) Int. Cl.
*A47C 27/08* (2006.01)

(52) U.S. Cl. ..... 5/711; 5/712; 5/706

(58) Field of Classification Search ..... 5/712, 711, 5/706, 710, 713, 644, 654, 655.3, 932, 682
See application file for complete search history.

(56) References Cited

U.S. PATENT DOCUMENTS 622,239 A * 4/1899 Lane ..... 5/712
787,137 A * 4/1905 Webb ..... 5/712
1,970,502 A * 8/1934 Hamza ..... 5/712
4,190,917 A * 3/1980 Calleance ..... 5/682
4,328,599 A * 5/1982 Mollura ..... 5/682
4,823,417 A * 4/1989 Fukuichi ..... 5/655.3
5,490,295 A * 2/1996 Boyd ..... 5/687
7,191,481 B2 * 3/2007 Hsu et al. ..... 5/712
2006/0130240 A1 * 6/2006 Hsu ..... 5/712
2012/0031265 A1 * 2/2012 Song et al. ..... 92/145

* cited by examiner

*Primary Examiner* — Robert G Santos
(74) *Attorney, Agent, or Firm* — Schwegman Lundberg & Woessner, P.A.

(57) ABSTRACT

An inflatable pad includes: an inflatable pad body having a looped surrounding layer interconnecting top and bottom layers to cooperatively define an inflatable space; and a reinforcing belt unit disposed in the inflatable space in the inflatable pad body and connected between the top and bottom layers of the inflatable pad body. The reinforcing belt unit includes two coupling belts and a main reinforcing belt. Each coupling belt is attached fixedly and partially to a corresponding one of the top and bottom layers of the inflatable pad body, and has a central portion that is spaced apart from the corresponding one of the top and bottom layers of the inflatable pad body and that is connected to a corresponding one of opposite looped end portions of the main reinforcing belt.

3 Claims, 4 Drawing Sheets

INFLATABLE PAD HAVING REINFORCING BELTS

CROSS-REFERENCE TO RELATED APPLICATION

This application claims priority of Chinese Application No. 201020284747.1, filed on Aug. 9, 2010.

BACKGROUND OF THE INVENTION

1. Field of the Invention

The invention relates to an inflatable pad, and more particularly to an inflatable pad having reinforcing belts.

2. Description of the Related Art

Referring to FIG. 1, a conventional inflatable pad is shown to include an inflatable pad body 1 configured with a closed inflatable space 10, and a plurality of reinforcing belts 13 (only one is shown) disposed in the inflatable space 10 for interconnecting top and bottom layers 11, 12 of the pad body. Each reinforcing belt 13 is made of a thermoplastic material, and has opposite generally-horizontal side portions 131 that are welded respectively to the top and bottom layers 11, 12, and a generally-vertically intermediate portion 132 interconnecting the side portions 131 for maintaining a distance between the top and bottom layers 11. It is noted that the side portions 131 of each reinforcing belt 13 become hard after welding. A connecting point 133 between the intermediate portion 132 and each side portion 131 is bent and is tensionally extended when a pressure, for example, user's weight, is applied to the inflatable pad. As a result, the connecting points 133 of the reinforcing belt 13 may be broken after a long period of use.

SUMMARY OF THE INVENTION

Therefore, the object of the present invention is to provide an inflatable pad that can overcome the aforesaid disadvantage.

According to the present invention, an inflatable pad comprises:

- an inflatable pad body having a top layer, a bottom layer, and a looped surrounding layer interconnecting the top and bottom layers to cooperatively define an inflatable space; and
- at least one reinforcing belt unit disposed in the inflatable space in the inflatable pad body and connected between the top and bottom layers of the inflatable pad body, the reinforcing belt unit including
  - two coupling belts, each of which is attached fixedly and partially to a corresponding one of the top and bottom layers of the inflatable pad body and has a central portion spaced apart from the corresponding one of the top and bottom layers of the inflatable pad body, and
  - a main reinforcing belt having opposite looped end portions that are connected respectively to the central portions of the coupling belts.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
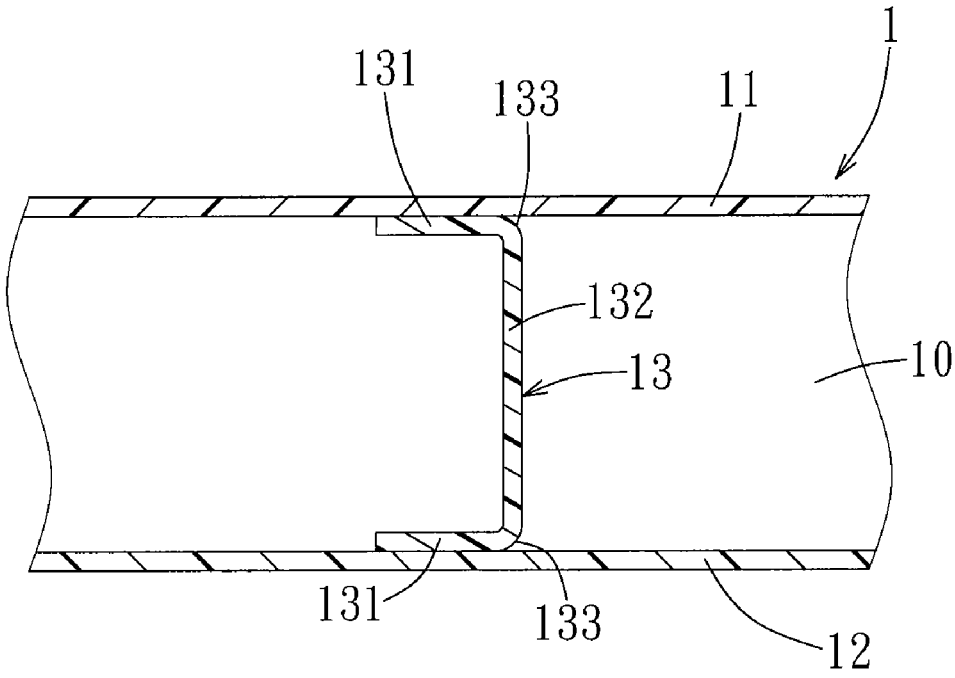
FIG. 1 PRIOR ART
FIG. 1 is a fragmentary schematic sectional view of a conventional inflatable pad.
Figure 2:
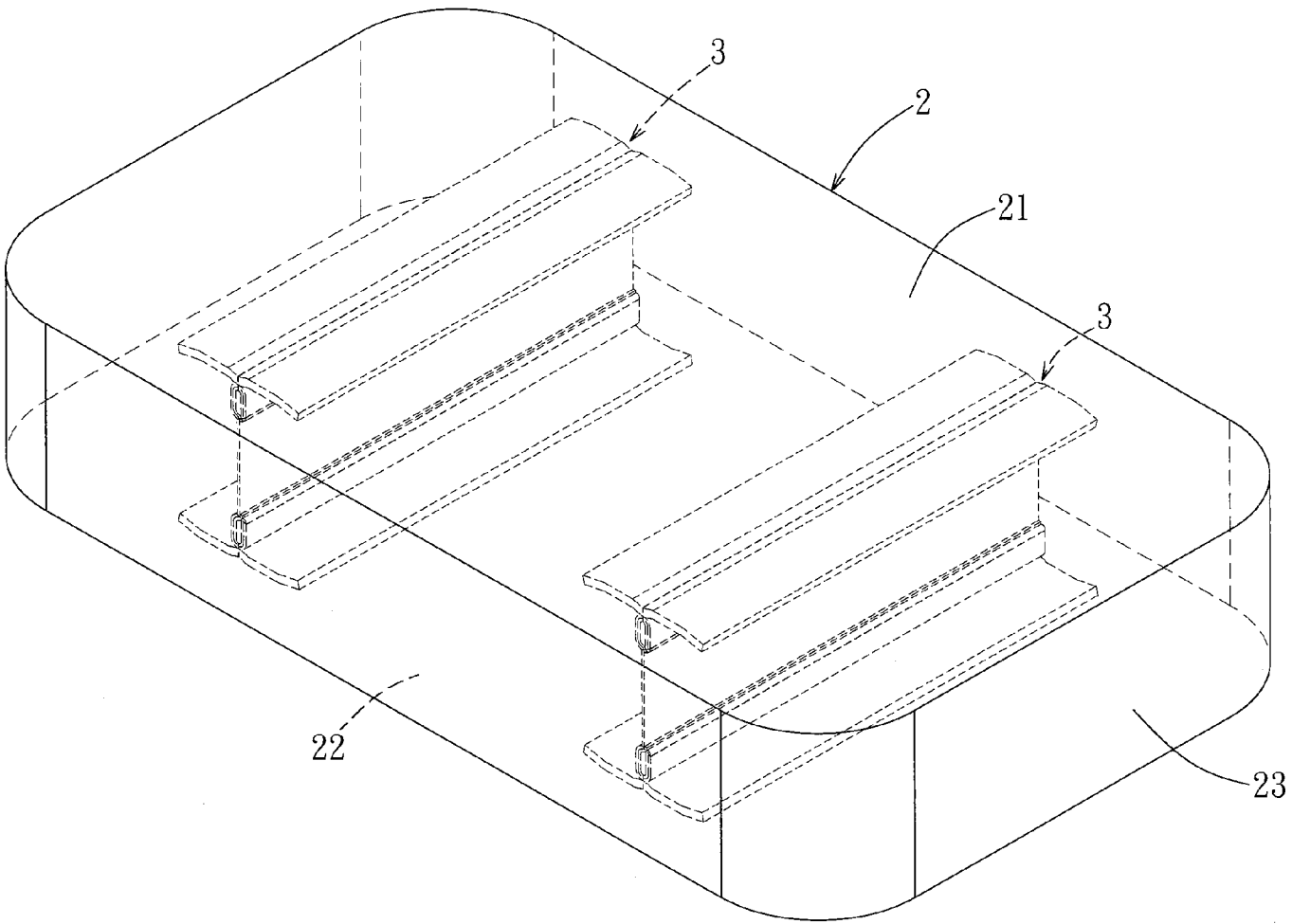
FIG. 2 is a perspective view showing the preferred embodiment of an inflatable bad according to the present invention.
Figure 3:
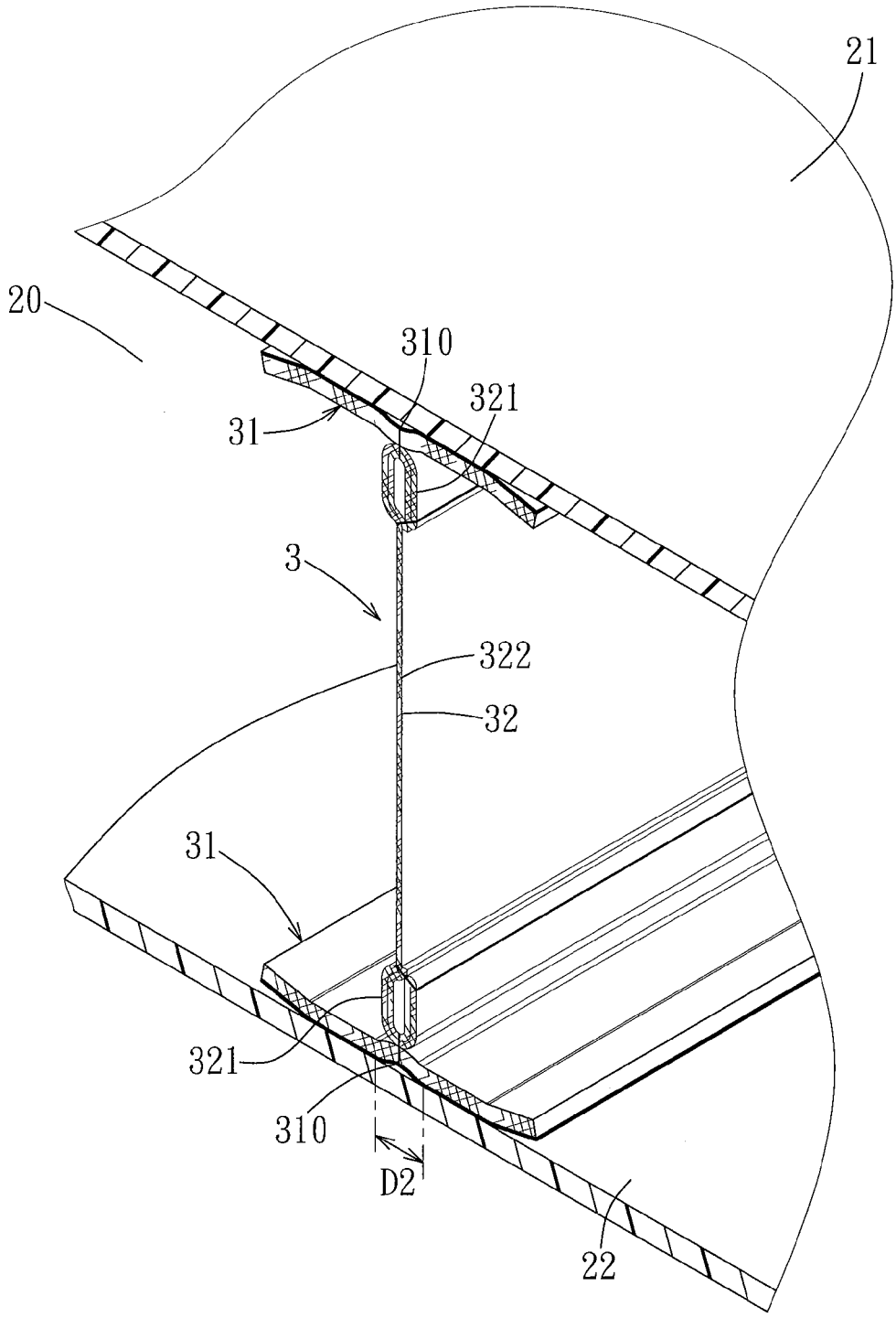
FIG. 3 is a fragmentary, partly sectional perspective view of the preferred embodiment.
Figure 4:
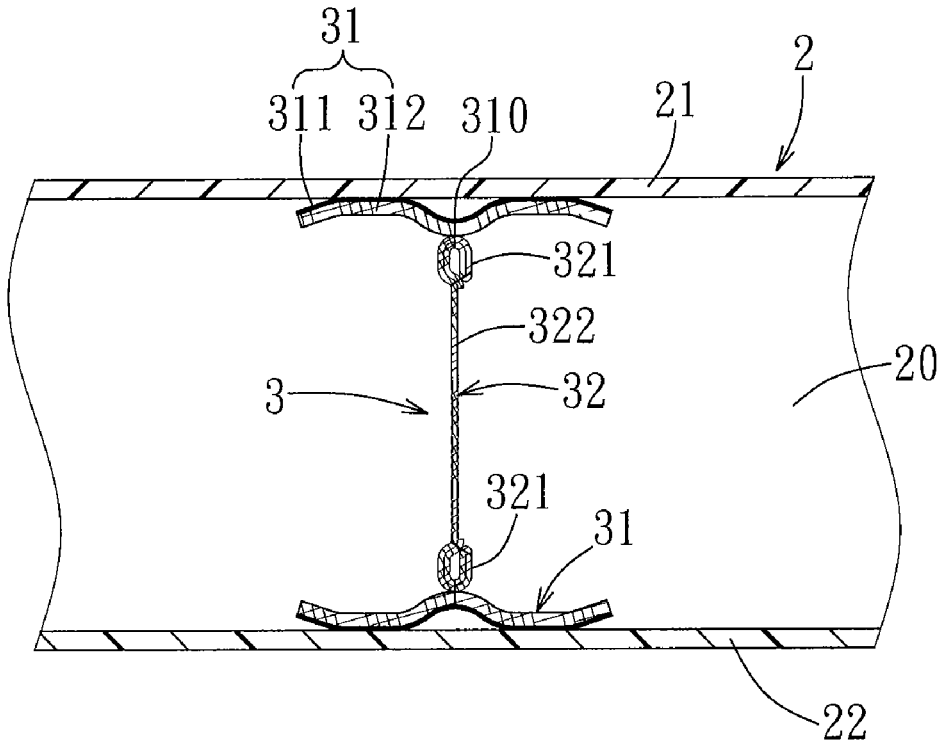
FIG. 4 is a fragmentary schematic sectional view of the preferred embodiment.

Referring to FIGS. 2 to 4, the preferred embodiment of an inflatable pad according to the present invention is shown to include an inflatable pad body 2, and two reinforcing belt units 3.

The inflatable pad body 2 has a top layer 21, a bottom layer 22, and a looped annular surrounding layer 23 interconnecting the top and bottom layers 21, 22 to cooperatively define an inflatable space 20.

The reinforcing belt units 3 are disposed spacedly in the inflatable space 20 in the inflatable pad body 2, and are connected between the top and bottom layers 21, 22 of the inflatable pad body 2. Each reinforcing belt unit 3 includes two coupling belts 31, and a main reinforcing belt 32.

For each reinforcing belt unit 3, each coupling belt 31 is attached fixedly and partially to a corresponding one of the top and bottom layers 21, 22 of the inflatable pad body 2, and has a central portion 310 spaced apart from the corresponding one of the top and bottom layers 21, 22 of the inflatable pad body 2, as best shown in FIG. 4. In this embodiment, each coupling belt 31 includes a belt body 312, and a thermoplastic layer 311 coated over the belt body 312 and welded partially to the corresponding one of the top and bottom layers 21, 22 of the inflatable pad body 2. Preferably, the belt body 312 of each coupling belt 31 is made of one of nylon and cotton cloth materials. In addition, the thermoplastic layer 311 of each coupling belt 31 is made of PVC (polyvinylchloride) material. The main reinforcing belt 32 has opposite looped end portions 321 that are connected respectively to the central portions 310 of the coupling belts 31, and a generally-vertical intermediate portion 322 interconnecting the looped end portions 321 for limiting a distance between the central portions 310 of the coupling belts 31. In this embodiment, the main reinforcing belt 32 is made of one of nylon and cotton cloth materials. The looped end portion 321 of the main reinforcing belt 32 are sewn respectively to the central portions 310 of the coupling belts 31, as shown in FIGS. 3 and 4.

In sum, for each reinforcing belt unit 3, the thermoplastic layer 311 of each coupling belt 31 has a relatively large area for bonding with the corresponding one of the top and bottom layers 21, 22 of the inflatable pad body 2 as compared to the prior art. The main reinforcing belt 32 interconnects the central portions 310 of the coupling belts 31. In addition, the central portion 310 of each coupling belt 31 is spaced apart from the corresponding one of the top and bottom layers 21, 22 of the inflatable pad body 2. As a result, the reinforcing belt units can provide larger bonding force for interconnecting the top and bottom layers 21, 22 of the inflatable pad body 2, thereby effectively maintaining the shape of the inflatable pad body 2 filled with air. Furthermore, the outer surface of the inflatable pad body 2 is less wavy, thereby providing a relatively comfortable surface for use. Moreover, a vertical pull force from the main reinforcing belt 32 is directly applied to the central portion 310 of each coupling belt 31. As a result, the vertical pull force from the main reinforcing belt 32 is divided onto two pull forces, each of which is applied to a corresponding welding portion of each coupling belt 31 through the central portion 310 and is smaller as compared to the prior art. Therefore, damage to the coupling belts 31 can be reduced, thereby prolonging the service life of the inflatable pad.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An inflatable pad comprising:

an inflatable pad body having a top layer, a bottom layer, and a looped surrounding layer interconnecting said top and bottom layers to cooperatively define an inflatable space; and at least one reinforcing belt unit disposed in said inflatable space in said inflatable pad body and connected between said top and bottom layers of said inflatable pad body, said reinforcing belt unit including two coupling belts, each of which is attached fixedly and partially to a corresponding one of said top and bottom layers of said inflatable pad body and has a central portion spaced apart from the corresponding one of said top and bottom layers of said inflatable pad body, and a main reinforcing belt having opposite looped end portions that are connected respectively to said central portions of said coupling belts.

2. The inflatable pad as claimed in claim 1, wherein each of said coupling belts includes a belt body, and a thermoplastic layer coated over said belt body and welded partially to the corresponding one of said top and bottom layers of said inflatable pad body.

3. The inflatable pad as claimed in claim 2, wherein:

said belt bodies of said coupling belts and said main reinforcing belt are made of one of nylon and cotton cloth materials; and said looped end portions of said main reinforcing belt are sewn respectively to said central portions of said coupling belts.

* * * * *